US005127389A

United States Patent [19]

Magnuson

[11] Patent Number: 5,127,389

[45] Date of Patent: Jul. 7, 1992

[54] ONE PERSON MISSILE-LAUNCHING TOY METHOD

[76] Inventor: Eric E. Magnuson, 2236 Cedar Trace Cir., Tampa, Fla. 33613

[21] Appl. No.: 401,005

[22] Filed: Aug. 31, 1989

Related U.S. Application Data

[63] Continuation-in-part of Ser. No. 36,691, Apr. 6, 1987, Pat. No. Des. 305,342.

[51] Int. Cl.[5] ..... F41B 3/02

[52] U.S. Cl. ..... 124/17; 124/20.1

[58] Field of Search ..... 124/16, 17, 20 R, 20 A, 124/20 B, 1, 41 R, 80, 20.1, 41.1; 446/26, 429

[56] References Cited

U.S. PATENT DOCUMENTS

| | | | |
|---|---|---|---|
| 1,072,988 | 9/1913 | Pratt et al. | 124/16 |
| 2,443,408 | 6/1948 | Walker | 124/20 R |
| 2,823,483 | 2/1958 | Malott | 124/41 R |
| 2,995,129 | 8/1961 | Malott | 124/20 R |
| 3,299,564 | 1/1967 | Quercetti | 124/20 R X |
| 4,240,396 | 12/1980 | Randoll | 124/17 |

FOREIGN PATENT DOCUMENTS

| | | | |
|---|---|---|---|
| 1286796 | 1/1962 | France | 124/20 R |

*Primary Examiner*—Randolph A. Reese
*Assistant Examiner*—John A. Ricci
*Attorney, Agent, or Firm*—Charles A. McClure

[57] ABSTRACT

Missile-launching toy, operable by one person as well as by more than one person. A single operator grasps hand grips on looped elastic tubing carrying a pocket member adapted to carry on its top or upper surface one or more toy missiles for launching. The foot of the operator is inserted removably, with leg bent, in a foot-engaging stirrup member on the bottom or under surface of the pocket member. The operator's leg is straightened, stretching the looped elastic tubing. After extending the leg and thereby stretching the elastic member, the operator extends his or her arms in the desired direction, and finally lets the strap slip off the foot, thereby launching the accommodated article.

3 Claims, 1 Drawing Sheet

FIG.-1
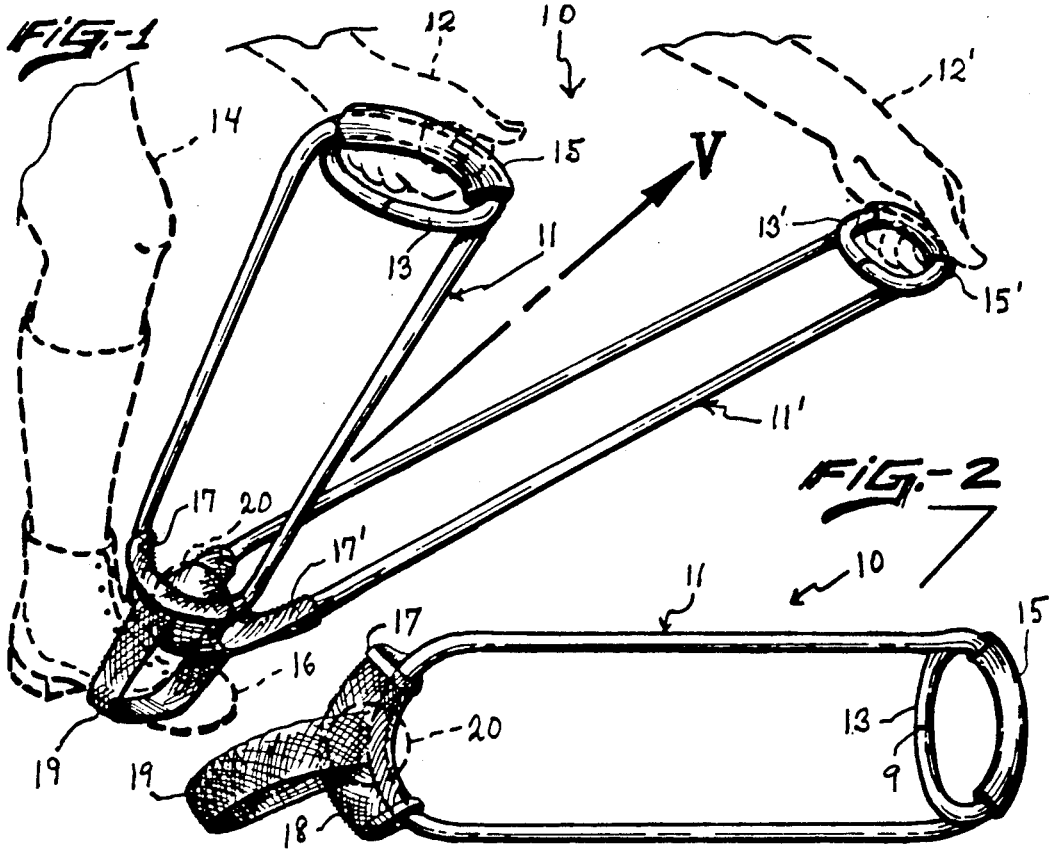
FIG.-2
FIG.-3
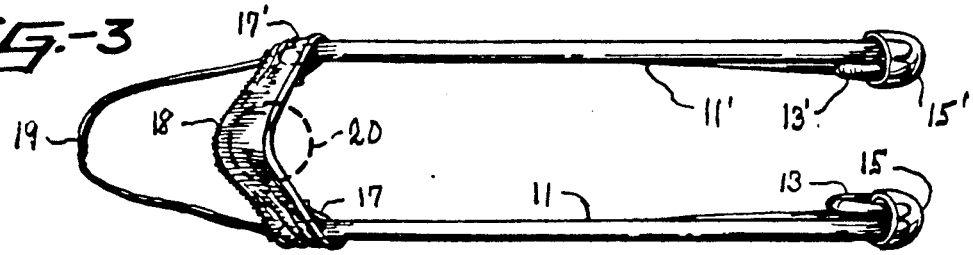
FIG.-4
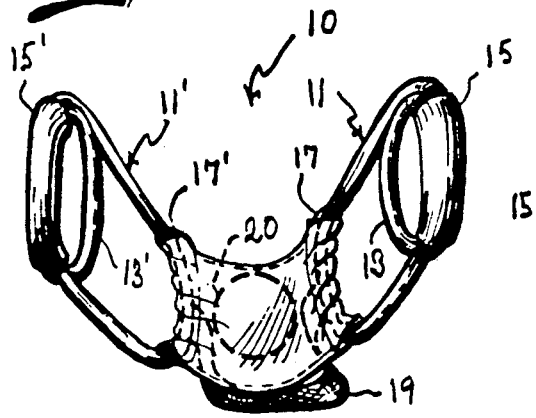
FIG.-5
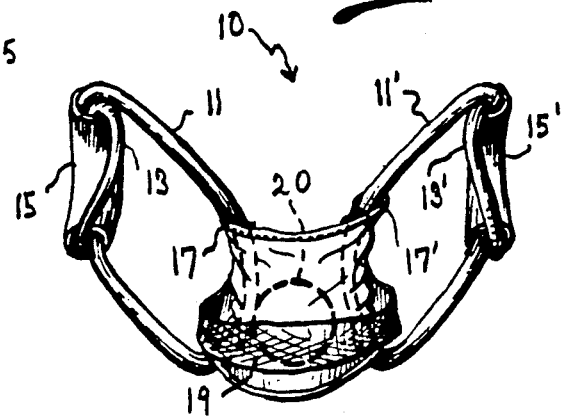

ONE PERSON MISSILE-LAUNCHING TOY METHOD

This is a continuation-in-part of my copending application, Ser. No. 36,691 filed Apr. 6, 1987, now issued as U.S. Pat. No. D 305,342.

TECHNICAL FIELD

This invention relates to a portable toy missile-launcher with elastic propulsion members, being appropriately proportioned to the human body and operable by a single person as well as more than one.

BACKGROUND OF THE INVENTION

Every child is familiar with the sight, if not the feel, of the classical forked stick sling-shot having rubber bands on either side as propulsion members and an intermediate thong to cradle a stone or similar missile. Such a toy is a descendant of the age-old leather sling, sometimes on the end of a stick, with which pebbles could be thrown to kill small game—or even Goliath by David.

Similar but on a much more lethal scale is the medieval catapult, fixed or on a movable base, with one or more flexure, tension, or torsion members made of leather, wood, or eventually metal, and able to throw huge rocks or metal balls. Unlike the sling, most catapults required more than one person to draw back and release.

As most children play warlike games, they also prefer increased firepower, preferably what one person can handle alone. A sling-shot as a "Game Balloon Launcher" wherein a funnel is adapted as the missile holder is described in Randoll U.S. Pat. No. 4,240,396.

The limited length of one person's arms imposes an undesirable limitation on sling-shots or similar missile launchers, especially as attention turns to a wider variety of interesting missiles, such as bags or balloons of water or even more noxious liquids.

SUMMARY OF THE INVENTION

A primary object of the present invention is to enable a single person to impart to a toy missile greater velocity than normally would be possible by manually stretching elastic launching means.

Another object of this invention is to increase the distance through which a single person can stretch elastic launching means and thereby launch a toy missile.

A further object of the invention is to provide portable toy missile-launching means and methods for accomplishing the foregoing objects.

In general, the objects of this invention are accomplished, in a toy missile-launcher, by means of a pocket member having a topside and an underside, being adapted on its underside to be engaged as a stirrup by a person's foot and on its topside to carry a toy missile for launching. It is flanked by and attached to one end of each of a pair of elastic members having hand grips at their opposite ends.

A toy missile is launchable by a single person according to the invention by the steps of placing a toy missile onto the topside of the pocket member, taking hold of the hand grips, one hand on each grip, extending the arms to aim the missile in a desired direction, inserting one foot into the stirrup and extending the corresponding leg, thereby stretching the stretchable elastic members, then slipping the foot out of the stirrup and thereby launching the missile.

Other objects of this invention, together with means and methods for attaining the various objects, will be apparent from the following description and the accompanying diagrams of a preferred embodiment, presented by way of example rather than limitation.

SUMMARY OF THE DRAWINGS

FIG. 1 is a perspective view of a toy missile-launcher according to this invention, shown partially stretched by a person whose hands and one leg and foot are fragmentarily shown in broken lines;

FIG. 2 is a side elevational view thereof, unstretched;

FIG. 3 is a front elevational view thereof, unstretched;

FIG. 4 is a top plan view thereof, unstretched; and

FIG. 5 is a bottom plan view thereof, unstretched.

DESCRIPTION OF THE INVENTION

FIG. 1 shows elastic missile-launching toy 10 of this invention being held in stretched condition by a person fragmentarily shown in broken lines. Hands 12 (right) and 12' (left) of such person are holding right and left sleevelike flexible hand grips 15, 15' surrounding part (approximately half) of small loops 13, 13' in endless larger loops of stretchable elastic propulsion means, here in the form of individual tubular members 11, 11'. At their opposite ends the tubular members are covered by sleeves 17, 17' of pliable pocket member 19, in the form of a generally rectangular fabric band or the like, shown here carrying generally spherical missile 20 (shown in broken lines) on its topside. Attached at its ends to (hanging below) respective side edges of the pocket is stirrup 19, shown engaged by boot 16—on the foot of leg 14 of such person. Vector V (with arrow) points away from missile 20 toward the track the missile will take when launched.

FIGS. 2 and 3 show toy missile-launcher 10 at its unstretched normal length in respective side (right) and front elevational views—as they would appear to such a person standing at the left side edge looking down as though the launcher were lying on the ground. Missile 20 still appears (in broken lines) lying against the topside of pocket member 18. Seam or join 9 is barely visible as a short continuous line transversely across the inner part of small loop 13 where the former ends of large loop 11 of tubing have been joined together, as by being heat-sealed or welded.

FIG. 4 shows toy missile-launcher 10 from the top as it would appear (if so supported) to such a person standing at the bottom edge of the view, looking down at pocket member 18 (in whose topside missile 20 is indicated in broken lines), and about to take hold of its hand grips 15, 15'. Stirrup 19 is barely visible underneath the pocket. Of course, it is unlikely that the toy would lie in exactly this position, which is illustrative only.

FIG. 5 is a view of same toy 10 from the bottom or underside, which is partly covered by stirrup 19. Short loops 13, 13' appear between hand grips 15, 15' and the viewer. It will be understood, of course, that the broken line showing of toy missile 20 here suggests the location of such missile on the topside of pocket member 18. Though hardly essential to an understanding of the invention, the various views are included for a thorough structural showing.

Operation of this toy is self-apparent from the diagrams just described briefly in connection with FIG.

1—or even in the absence of such description. The directional angle of take-off of missile 20 is determined by a player launching it, as by altering degrees of arm and leg extension appropriately. Care should be taken by every player, including the launcher, to keep all body parts away from the missile trajectory, whose initial track is indicated by vector V in FIG. 1. It is apparent that when a missile is in place on the topside of the pocket member, and the elastic propulsion means is stretched as shown, a tipping upward of the front of such foot causes the stirrup to slide off, whereupon the stretched elastic propulsion means contracts rapidly to its normal length (or momentarily even less) and so launches the missile.

No special materials are required in making or using this toy. The stretchable elastic means is composed of suitable elastomeric material, such as natural or synthetic rubber. The hand grips are conveniently made of somewhat less elastic but flexible polymeric material, such as a polyhydrocarbon (e.g., polyethylene, polypropylene). The pocket member, attaching sleeves, and stirrup are composed of pliable fabric or similar material, whether natural or synthetic, woven or nonwoven, and sewed or bonded as by heat or otherwise, into the desired position.

If desired, the respective looped propulsion members could be combined into one loop about twice as long, with the sleeved pocket member carried slidably or fixedly midway of its ends, which would be gripped by a player as before. The loop(s) need not be endless but could terminate at hand grips of the illustrated or other types. Several children could play together with this toy, as by a pair holding the respective handles and a third drawing the elastic propulsion means to extended length by hand, perhaps further than a single child could draw it by combined arm and leg extension, but characteristically each child prefers to have a single launcher.

Variants from the preferred embodiment have been suggested, and other modifications may be made in the illustrated apparatus or method, as by adding, deleting, combining, or subdividing parts or steps, while retaining at least some advantages and benefits of the invention—which itself is defined in the following claims.

The claimed invention:

1. Method of using a missile-launching toy having a pocket member having a topside and an underside, being adapted to carry a toy missile on its topside temporarily for launching, a pair of stretchable elastic members flanking and attached at one end of each to the pocket member and having at their opposite ends hand grips adapted to be held by the hands of a single person, each elastic member having a loop of stretchable material, and a stirrup member attached to the underside of the pocket member and adapted to receive the foot of a person holding the hand grips;

comprising the following steps performed by a single person:

placing a toy missile onto the topside of the pocket member, taking hold of the hand grips, one hand on each grip, inserting one foot into the stirrup and extending the corresponding leg and thereby stretching the stretchable elastic members, extending the arms to aim the missile in a desired direction, and slipping the foot out of the stirrup and thereby launching the missile in the desired direction.

2. Method of launching a toy missile oneself, comprising placing a toy missile on top of a pliable pocket member having a top-side and an underside an adapted to carry a toy missile on its top-side temporarily for launching, taking hold of hand grips on a pair of stretchable elastic members flanking and attached at one end of each to the pocket member, and inserting a foot into a stirrup member attached to the underside of the pocket member and so adapted, extending the corresponding leg and thereby stretching the stretchable elastic members, extending the arms to aim the missile in a desired direction, and slipping the foot out of the stirrup and thereby launching the missile in the desired direction.

3. Method of operating a portable missile-launching toy operable by oneself alone, comprising pocket means with a top surface adapted to carry a toy missile, stirrup means underneath and connected to the pocket means and engageable by one's foot while standing upright on one's other foot, a pair of launching members grippable by one's hands, stretchable to increased length by extending one's arms, and releasable to unstretched length upon removal of one's foot from the stirrup, to launch a toy missile, comprising the steps of gripping the respective launching members with one's hands, p1 placing a toy missile on the top surface of the pocket means, engaging the stirrup means with one foot while standing upright on the other foot, extending one's arms to stretch the launching members from the interconnected pocket means and stirrup means to aim the missile in a desired launching direction, and tipping the foot engaged in the stirrup means upward and so slipping it out from the stirrup, enabling the pair of stretched launching members to contract abruptly to their unstretched length, and throwing the toy missile therefrom in the aimed direction.

* * * * *